US007201301B2

(12) United States Patent
Moeller et al.

(10) Patent No.: US 7,201,301 B2
(45) Date of Patent: Apr. 10, 2007

(54) EXHAUST SYSTEM FOR COMBUSTION-POWERED FASTENER-DRIVING TOOL

(75) Inventors: Larry M. Moeller, Mundelein, IL (US); James E. Doherty, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/028,023

(22) Filed: Jan. 3, 2005

(65) Prior Publication Data

US 2005/0173486 A1 Aug. 11, 2005

Related U.S. Application Data

(60) Provisional application No. 60/543,053, filed on Feb. 9, 2004.

(51) Int. Cl.
*B25C 1/04* (2006.01)

(52) U.S. Cl. ..... 227/8; 227/10; 227/130; 123/46 SC

(58) Field of Classification Search ..... 227/8, 227/9, 130, 10; 123/46 SC, 46 R
See application file for complete search history.

(56) References Cited

U.S. PATENT DOCUMENTS 4,040,554 A * 8/1977 Haytayan ..... 227/8
4,384,668 A * 5/1983 Tutomu et al. ..... 227/8
4,483,473 A * 11/1984 Wagdy ..... 227/8
4,483,474 A * 11/1984 Nikolich ..... 227/8
4,522,162 A 6/1985 Nikolich
4,534,500 A * 8/1985 Jochum ..... 227/8
5,897,043 A 4/1999 Veoukas et al.
5,909,836 A 6/1999 Shkolnikov et al.
6,138,887 A * 10/2000 Nayrac et al. ..... 227/8
6,145,724 A 11/2000 Shkolnikov
6,164,510 A * 12/2000 Deieso et al. ..... 227/130
6,666,366 B2 * 12/2003 Rosenbaum et al. ..... 227/8
6,715,655 B1 4/2004 Taylor et al.
6,889,885 B2 5/2005 Ohmori
6,966,478 B2 * 11/2005 Adams et al. ..... 227/10
2004/0026476 A1 * 2/2004 Shima et al. ..... 227/130

FOREIGN PATENT DOCUMENTS

DE 198 53 555 A 5/2000

* cited by examiner

*Primary Examiner*—John Sipos
*Assistant Examiner*—Michelle Lopez
(74) *Attorney, Agent, or Firm*—Greer, Burns & Crain, Ltd.; Lisa M. Soltis; Mark W. Croll

(57) ABSTRACT

A combustion-powered fastener-driving tool includes a combustion-powered power source including a cylinder defining a path for a reciprocating piston and an attached driver blade, the piston reciprocating between a pre-firing position achieved prior to combustion and a bottom out position. Upon combustion in the power source, the cylinder includes at least one exhaust valve configured for releasing combustion gases from the cylinder. The at least one exhaust valve is dimensioned so that sufficient gas is released to reduce post-combustion pressure in the cylinder to approximately one atmosphere in the time available for the piston to travel past the at least one exhaust valve and return to the at least one exhaust valve.

7 Claims, 2 Drawing Sheets

EXHAUST SYSTEM FOR COMBUSTION-POWERED FASTENER-DRIVING TOOL

RELATED APPLICATION

This application claims priority under 35 USC § 120 from U.S. Ser. No. 60/543,053, filed Feb. 9, 2004.

BACKGROUND

The present invention relates generally to fastener-driving tools used to drive fasteners into workpieces, and specifically to combustion-powered fastener-driving tools, also referred to as combustion tools.

Combustion-powered tools are known in the art, and exemplary tools produced by Illinois Tool Works of Glenview, Ill., also known as IMPULSE® brand tools for use in driving fasteners into workpieces, are described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 5,897,043 and 6,145,724 all of which are incorporated by reference herein.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Combustion-powered tools now offered on the market are sequentially operated tools. The tool must be pressed against the work, collapsing the work or workpiece contact element (WCE) before the trigger is pulled for the tool to fire a nail. This contrasts with tools which can be fired in what is known as repetitive cycle operation. In other words, the latter tools will fire repeatedly by pressing the tool against the workpiece if the trigger is held in the depressed mode. These differences manifest themselves in the number of fasteners that can be fired per second for each style tool. The repetitive cycle mode is substantially faster than the sequential fire mode; 4 to 7 fasteners can be fired per second in repetitive cycle as compared to only 2 to 3 fasteners per second in sequential mode.

Effective and complete piston return to the pre-firing position after combustion is required for dependable operation in sequential firing combustion tools as well as repetitive cycle combustion tools. An important factor that limits combustion-powered tools to sequential operation is the manner in which the drive piston is returned to the initial position after the tool is fired. Combustion-powered tools utilize self-generative vacuum to perform the piston return function. Piston return of the vacuum-type requires significantly more time than that of tools that use positive air pressure from the supply line for piston return.

With combustion-powered tools of the type disclosed in the patents listed above, by firing rate and control of the valve sleeve the operator controls the time interval provided for the vacuum-type piston return. The formation of the vacuum occurs following the combustion of the mixture and the exhausting of the high-pressure burnt gases. With residual high temperature gases in the tool, the surrounding lower temperature aluminum components cool and collapse the gases, thereby creating a vacuum. In many cases, the tool operating cycle rate is slow enough, such as in trim applications that vacuum return works consistently and reliably.

However, for those cases where a tool is operated at a much higher cycle rate, the operator can open the combustion chamber early by removing the tool from the workpiece, allowing the valve sleeve to return to a rest position, causing the vacuum to be lost. Without vacuum to move it, piston travel stops before reaching the top of the cylinder. This leaves the driver blade in the guide channel of the nose, thereby preventing the nail strip from advancing. The net result is no nail in the firing channel and no nail fired in the next shot.

Conventional combustion tools using the sequential-fire mode assure adequate closed combustion chamber dwell time with a chamber lockout mechanism that is linked to the trigger. This mechanism holds the combustion chamber closed until the operator releases the trigger, thus taking into account the operator's relatively slow musculature response time. In other words, the physical release of the trigger consumes enough time of the firing cycle to assure piston return. It is disadvantageous to maintain the chamber closed longer than the minimum time to return the piston, as cooling and purging of the tool is prevented.

Piston return in vacuum return combustion tools is the longest single process in the tool's engine cycle, which is defined as the time from when ignition occurs and the piston is returned to the pre-firing position. Times for piston return can range to 75 or even over 100 milliseconds. These times are controlled by the rate and magnitude of vacuum formation. When the tool is operated in a repetitive cycle mode, a faster cycle time is desired and thus less time is available for achieving proper piston return. A piston that does not fully return will prevent the tool from firing properly in a subsequent cycle.

Thus, there is a need for a combustion-powered fastener-driving tool provided with an enhanced piston return which is capable of operating in a repetitive cycle mode, and also which is capable of enhancing operation of sequentially firing combustion-powered tools.

BRIEF SUMMARY

The above-listed needs are met or exceeded by the present combustion-powered fastener-driving tool which overcomes the limitations of the current technology. Among other things, the present tool incorporates an exhaust valve dimensioned for enhancing piston return by facilitating the release of exhaust gas from the combustion chamber, thus accelerating the creation of vacuum responsible for piston return.

More specifically, the present combustion-powered fastener-driving tool includes a combustion-powered power source including a cylinder defining a path for a reciprocating piston and an attached driver blade, the piston reciprocating between a pre-firing position achieved prior to combustion and a bottom out position. Upon combustion in the power source, the cylinder includes at least one exhaust valve configured for releasing combustion gases from the cylinder. The at least one exhaust valve is dimensioned so that sufficient gas is released to reduce combustion pressure in the cylinder to approximately one atmosphere in the time available for the piston to travel past the at least one exhaust valve and return to the at least one exhaust valve.

DETAILED DESCRIPTION

Figure 1:
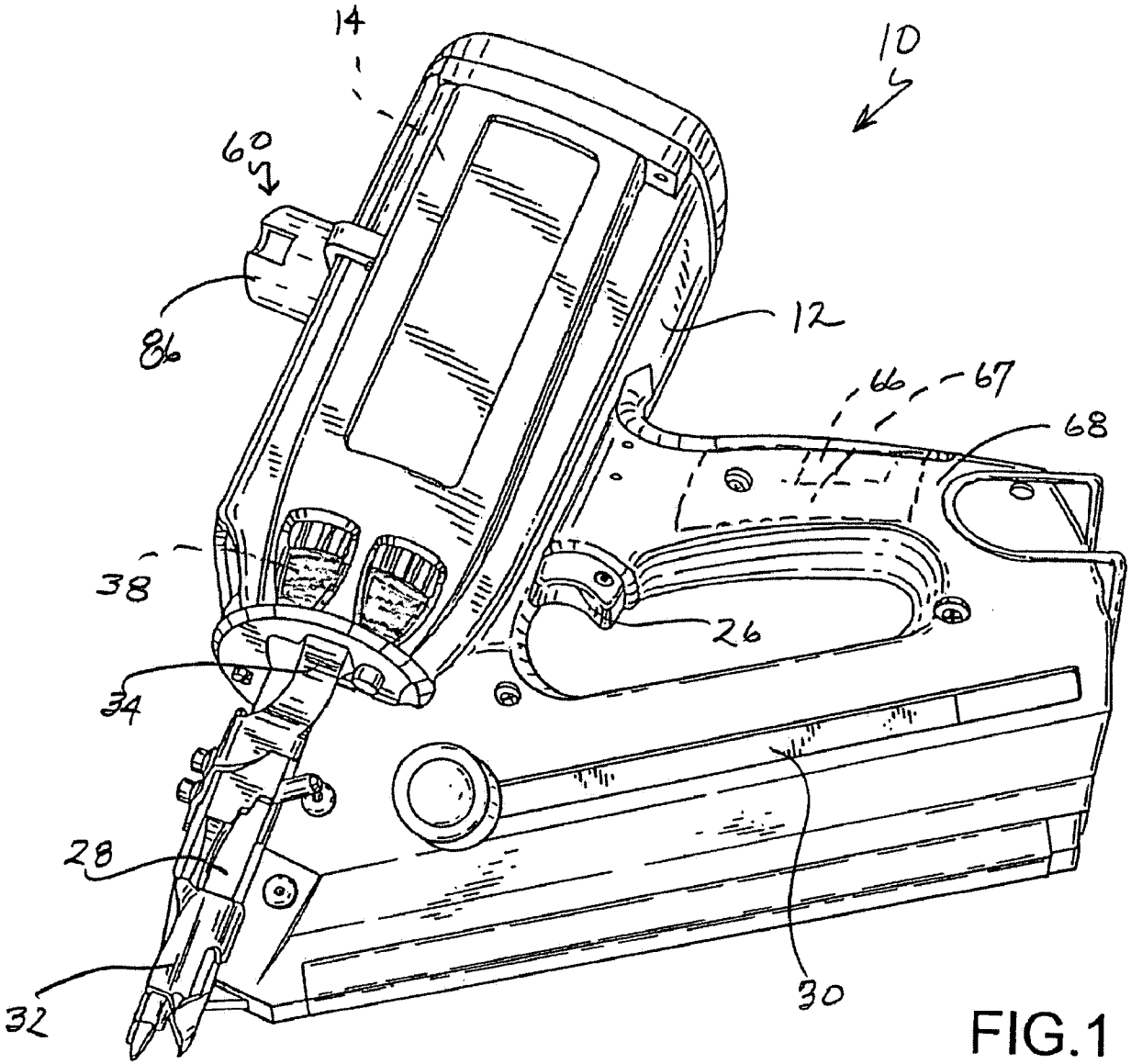
FIG. 1 is a perspective view of a combustion tool suitable for incorporating the present exhaust system.
Figure 2:
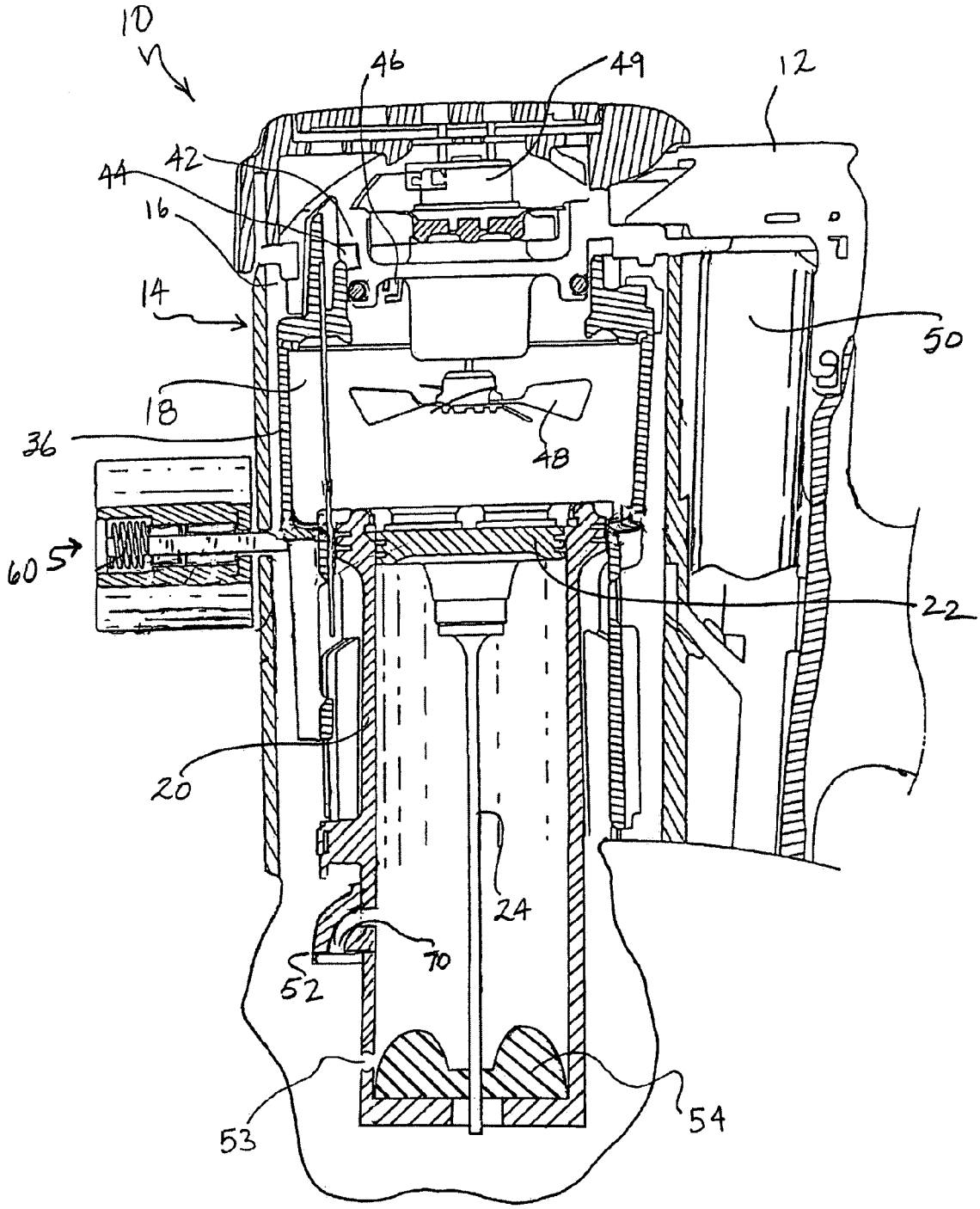
FIG. 2 is a fragmentary vertical cross-section of a fastener-driving tool incorporating the present exhaust system.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

Through depression of a trigger 26, an operator induces combustion within the combustion chamber 18, causing the driver blade 24 to be forcefully driven downward through a nosepiece 28. The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, an upper end of which partially defines the combustion chamber 18. Depression of the tool housing 12 against the workpiece contact element 32 in a downward direction (other operational orientations are contemplated as are known in the art) causes the workpiece contact element to move from a rest position to a pre-firing position (FIG. 2). This movement overcomes the normally downward biased orientation of the workpiece contact element 32 caused by a spring 38 (shown hidden in FIG. 1). The position of the spring 38 may vary to suit the application, and locations displaced farther from the nosepiece 28 are contemplated.

In the pre-firing position (FIG. 2), the combustion chamber 18 is sealed, and is defined by the piston 22, the valve sleeve 36 and a cylinder head 42, which accommodates a chamber switch 44 and a spark plug 46. In the preferred embodiment of the present tool 10, the cylinder head 42 also is the mounting point for a cooling fan 48 and a fan motor 49 powering the cooling fan, the fan and at least a portion of the motor extending into the combustion chamber 18 as is known in the art.

Firing is enabled when an operator presses the workpiece contact element 32 against a workpiece. This action overcomes the biasing force of the spring 38, causes the valve sleeve 36 to move upward relative to the housing 12, and sealing the combustion chamber 18 and activating the chamber switch 44. This operation also induces a measured amount of fuel to be released into the combustion chamber 18 from a fuel canister 50 (shown in fragment).

Upon a pulling of the trigger 26, the spark plug 46 is energized, igniting the fuel and air mixture in the combustion chamber 18 and sending the piston 22 and the driver blade 24 downward toward the waiting fastener. As the piston 22 travels down the cylinder 20, it pushes a rush of air which is exhausted through at least one petal or check valve 52 and at least one vent hole 53 located beyond piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20 until near atmospheric pressure conditions are obtained and the check valve 52 closes. Due to internal pressure differentials in the cylinder 20, the piston 22 is returned to the pre-firing position shown in FIG. 2.

As described above, one of the issues confronting designers of combustion-powered tools of this type is the need for a rapid return of the piston 22 to pre-firing position and improved control of the chamber 18 prior to the next cycle. While an issue with sequentially-firing combustion-powered tools, this need is more important if the tool is to be fired in a repetitive cycle mode, where an ignition occurs each time the workpiece contact element 32 is retracted, and during which time the trigger 26 is continually held in the pulled or squeezed position.

To accommodate these design concerns, the present tool 10 preferably incorporates an optional lockout device, generally designated 60, configured for preventing the reciprocation of the valve sleeve 36 from the closed or firing position until the piston 22 returns to the pre-firing position. This holding or locking function of the lockout device 60 is operational for a specified period of time required for the piston 22 to return to the pre-firing position. Thus, the operator using the tool 10 in a repetitive cycle mode can lift the tool from the workpiece where a fastener was just driven, and begin to reposition the tool for the next firing cycle.

Generally speaking, the device 60 includes a reciprocating, solenoid-type powered latch which engages the valve sleeve 36 according to a designated timing sequence controlled by a main tool control unit. It will be appreciated that a variety of mechanisms may be provided for retaining the combustion chamber sealed during this period, and the depicted lockout device is by no means the only way this operation can be performed.

Due to the shorter firing cycle times inherent with repetitive cycle operation, the lockout device 60 ensures that the combustion chamber 18 will remain sealed, and the differential gas pressures maintained so that the piston 22 will be drawn back up without a premature opening of the chamber 18, which would normally interrupt piston return. With the present lockout device 60, the return of the piston 22 and opening of the combustion chamber 18 can occur while the tool 10 is being moved toward the next workpiece location. It is to be understood that the lockout device 60 is contemplated for use with some types of combustion-powered tools, but is not considered a required component.

The time required for desired piston return, is controlled by the extent that combustion gas is exhausted before the piston begins its return after having struck and rebounded from the bumper. Typical combustion tool construction locates exhaust ports at some convenient distance above the bumper, so that combustion gas can exhaust once the piston passes the ports and until it passes again on the return stroke. It is usually desirable to put the ports close to the bumper to gain the longest power stroke possible. This causes the exhaust time to be very short; typically on the order of only a few milliseconds. Once internal tool pressure equals atmospheric pressure, a check valve system closes the exhaust port, allowing vacuum to form in the tool to begin piston return.

It has been found that exhaust ports typically found in combustion tools are too small for the pressurized combustion gas to be fully removed. This causes the piston return time to be unnecessarily long, or the piston to rebound or oscillate back and forth—even stop for a time—as the vacuum develops. The piston 22 rebounding off of the bumper or bouncing off of the air cushion formed below the piston can cause such oscillation. The air cushion is formed when the exhaust ports 70, associated with the petal valves 52, and the vent hole 53 around the bumper 54 do not effectively allow for the swept volume caused by the downward movement of the piston 22 to be removed in a timely fashion. In cases where the piston 22 rebounds above the exhaust ports 70, the remaining residual combustion pressure has been known to force the piston back down to the bumper a second time. When this occurs, there is often a telltale mark on the work as evidence of the "double strike", which is undesirable in finish work applications. Poor exhaust has been found to limit the tool cycle rate, especially in high-speed applications.

In the present tool 10, the desired short firing cycle times expected in the repetitive cycle mode are achieved in part by sizing the exhaust ports 70 (FIG. 2) to match the volume of combustion gases that must be exhausted such that the pressure inside the cylinder 20 is essentially reduced to one atmosphere. While tedious, it is contemplated that the proper port area can of course be found empirically for each specific case.

In the course of the development of the present tool 10, the inventors developed a rule that can be used once the time available for exhausting is selected. The latter is defined by the location of the exhaust ports 70 relative to the bumper 54, the stiffness of the bumper, the air cushion pressure, and the velocity of the piston 22. The ratio of the volume to be exhausted (in cubic inches) to the effective port area, in square inches is approximately ten times the required exhaust time (in milliseconds). Ideally, it is desired that after combustion, the zone of the cylinder 20 above the piston 22 is at atmospheric pressure as the piston reaches the bottom out position against the bumper 54. The differential pressure in the cylinder 20 on either side of the piston 22 helps return the piston back to the pre-firing position.

It has been found that the above relation may be expressed as $V/A=20+8.4t$, where V is the expandable volume of the combustion chamber, A is the effective port area, V/A is the ratio of exhaust volume to effective port area, and t=time in milliseconds that the exhaust ports 70 allow fluid communication between the cylinder 20 and atmosphere. In other words, the time "t" represents the interval beginning when the piston 22 passes the exhaust ports 70, hits the bumper, and returns back toward the combustion chamber and passes over the exhaust ports again. For effective piston return, the value of "t" is approximately 4 milliseconds, although available times can range from 2 to 10 milliseconds. For a typical combustion-powered tool 10 with an exhaust volume of 40 cubic inches, in applying the above formula, the available time ranges from 2 to 10 milliseconds and requires a range of corresponding minimum effective port areas of 1.1 and 0.4 square inches respectively to achieve effective exhaust conditions.

It has been found that the above relationships in sizing of the exhaust ports 70 can be utilized to enhance performance in combustion tools of many types, including those designed for repetitive cycle mode, in which a lockout device 60 may be provided, as well as combustion tools operating in a sequential firing mode, in which such lockout devices are usually not required.

While a particular embodiment of the present exhaust system for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source including a cylinder defining a path for a reciprocating piston and an attached driver blade;

said piston reciprocating between a pre-firing position achieved prior to combustion and a bottom out position, upon combustion in said power source, said cylinder includes at least one exhaust valve which is a check valve configured for releasing combustion gases from said cylinder and preventing an influx of air in said cylinder through said valve, thus setting up a thermal vacuum in said cylinder after combustion;

said at least one exhaust valve having at least one exhaust port being dimensioned as a function of a volume of a combustion chamber defined in part by an upper end of said piston so that sufficient gas is released to reduce combustion pressure in said cylinder to approximately one atmosphere in a designated time period available for said piston to travel past said at least one exhaust valve and return to said at least one exhaust valve.

2. The tool of claim 1 wherein said at least one exhaust valve is a petal valve.

3. The tool of claim 1 wherein said exhaust valve is dimensioned according to the formula $V/A=20+8.4t$, where V is an expandable volume of the combustion chamber, A is an effective exhaust port area, V/A is a ratio of exhaust volume to effective port area, and t is said designated time period measured in milliseconds, wherein t is in the range of 2 to 10 milliseconds.

4. The tool of claim 1 wherein said exhaust valve has a port area in the range of 0.4 to 1.1 square inches.

5. The tool of claim 1 further including a valve sleeve lockout device.

6. A combustion-powered fastener-driving tool, comprising:

a combustion-powered power source including a cylinder defining a path for a reciprocating piston and an attached driver blade;

said piston reciprocating between a pre-firing position achieved prior to combustion and a bottom out position, upon combustion in said power source, said cylinder includes at least one exhaust valve which is a check valve configured for releasing combustion gases from said cylinder and preventing an influx of air in said cylinder through said valve, thus setting up a thermal vacuum in said cylinder after combustion;

said at least one exhaust valve having at least one exhaust port being dimensioned as a function of a volume of a combustion chamber so that sufficient gas is released to reduce combustion pressure in said cylinder to approximately one atmosphere in a designated time period available for said piston to travel past said at least one exhaust valve and return to said at least one exhaust valve;

wherein said exhaust valve is dimensioned according to the formula $V/A=20+8.4t$, where V is an expandable volume of the combustion chamber, A is an effective exhaust port area, V/A is a ratio of exhaust volume to effective port area, and t is time in milliseconds, wherein t is said designated time period measured in the range of 2 to 10 milliseconds, and wherein said exhaust valve has a port area in the range of 0.4 to 1.1 square inches.

7. A combustion-powered fastener-driving tool, comprising:

a combustion-powered power source including a cylinder defining a path for a reciprocating piston and an attached driver blade;

said piston reciprocating between a pre-firing position achieved prior to combustion and a bottom out position, upon combustion in said power source, said cylinder includes at least one exhaust valve which is a check valve configured for releasing combustion gases from said cylinder and preventing an influx of air in said cylinder through said valve, thus setting up a thennal vacuum in said cylinder after combustion;

said at least one exhaust valve having at least one exhaust port being dimensioned as a function of a volume of a combustion chamber so that sufficient gas is released to reduce combustion pressure in said cylinder so that sufficient gas is released to reduce combustion pressure in said cylinder to approximately one atmosphere in a period between 2 and 10 milliseconds available for said piston to travel past said at least one exhaust valve and return to said at least one exhaust valve.

* * * * *